US005797243A

United States Patent [19]

Tagliaferri et al.

[11] Patent Number: 5,797,243

[45] Date of Patent: Aug. 25, 1998

[54] METHOD FOR CLOSING A FILTER BAG FOR INFUSIBLE PRODUCTS AND FOR CONNECTING A TAGGED THREAD THERETO

[75] Inventors: Roberto Tagliaferri, Castel S. Pietro; Paolo Cardinali, Conselice, both of Italy

[73] Assignee: I.M.A. Industria Macchine Automatiche S.p.A., Ozzano Emilia, Italy

[21] Appl. No.: 737,241

[22] PCT Filed: May 25, 1995

[86] PCT No.: PCT/IT95/00090

§ 371 Date: Nov. 15, 1996

§ 102(e) Date: Nov. 15, 1996

[87] PCT Pub. No.: WO95/32905

PCT Pub. Date: Dec. 7, 1995

[30] Foreign Application Priority Data

May 27, 1994 [IT] Italy ..... BO94A0249
Feb. 22, 1995 [IT] Italy ..... BO95A0061

[51] Int. Cl.[6] ..... B65B 29/04

[52] U.S. Cl. ..... 53/413; 53/134.2; 206/0.5

[58] Field of Search ..... 206/0.5; 53/134.2, 53/413

[56] References Cited

U.S. PATENT DOCUMENTS

| | | | |
|---|---|---|---|
| 1,493,982 | 5/1924 | Hirschhorn | 53/413 X |
| 1,525,161 | 2/1925 | Allatt | 53/413 X |
| 1,557,032 | 10/1925 | Cooper | 53/413 |
| 1,801,588 | 4/1931 | Cooper | 53/413 |
| 2,148,587 | 2/1939 | Slocum | 53/413 |
| 2,186,087 | 1/1940 | Yates | 53/413 X |
| 2,187,417 | 1/1940 | Doble | 206/0.5 X |
| 2,193,974 | 3/1940 | Luckhaupt | 206/0.5 X |
| 2,224,753 | 12/1940 | Yates | 53/413 |
| 4,055,668 | 10/1977 | Kopp | 206/0.5 X |

FOREIGN PATENT DOCUMENTS

| | | | |
|---|---|---|---|
| 6612230 | 3/1967 | Germany | 206/0.5 |

*Primary Examiner*—Daniel Moon
*Attorney, Agent, or Firm*—McAulay Fisher Nissen Goldberg & Kiel, LLP

[57] ABSTRACT

A single dose filter bag for infusible product is closed by folding a flap made in the upper part of the filter bag, attaching a connecting thread to the filter bag and to a pickup tag by first and second terminal portions respectively of the connecting thread, forming a short vertical or horizontal stitch using first and second auxiliary threads respectively.

16 Claims, 8 Drawing Sheets

FIG. 9a
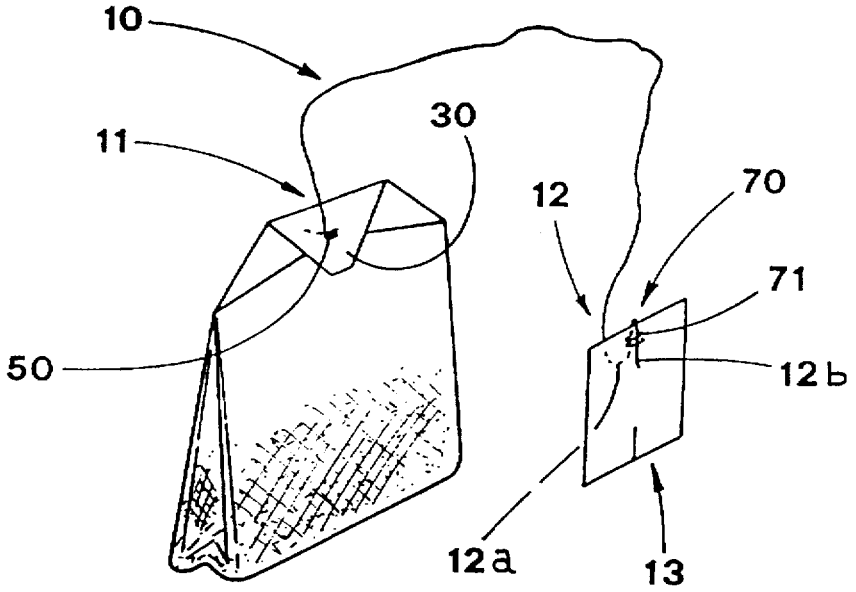
FIG. 9c
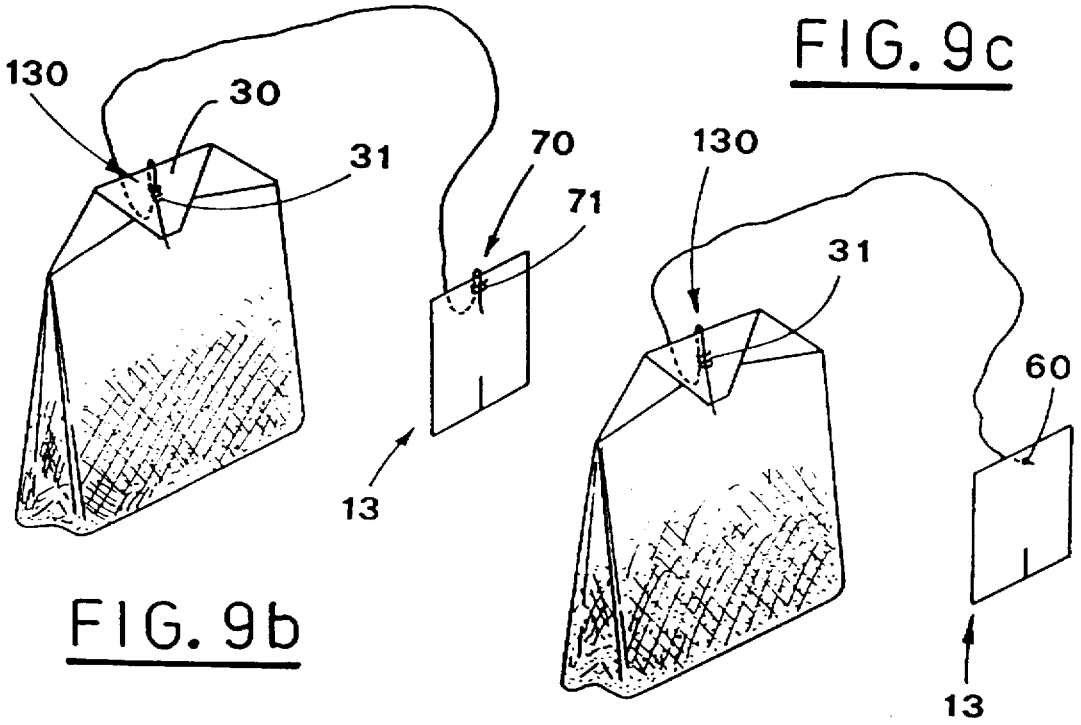
FIG. 9b

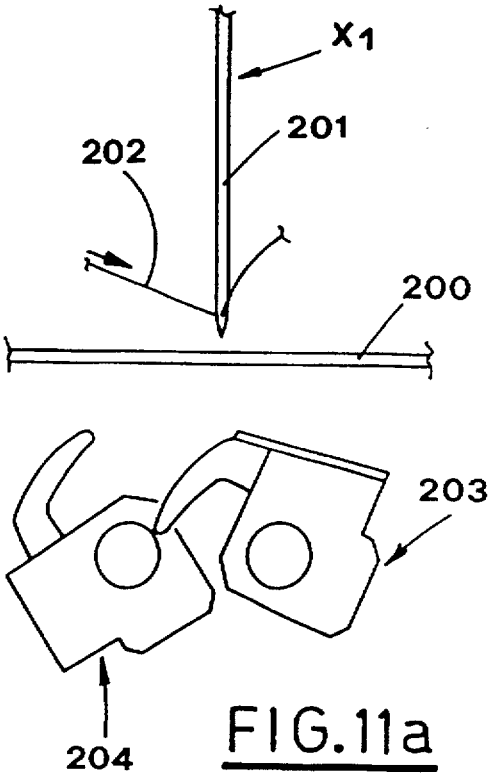
FIG.11a
FIG.11b
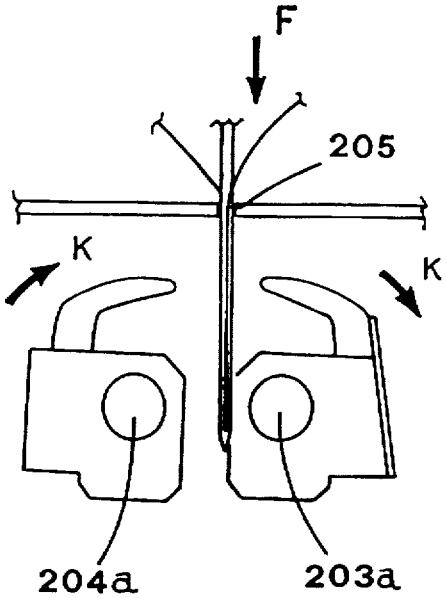
FIG.11c
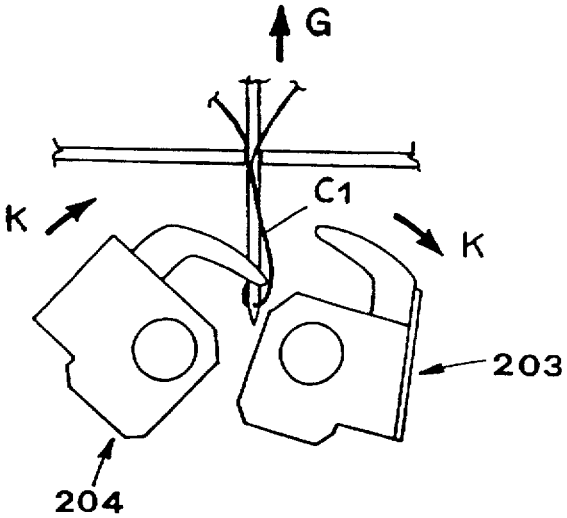
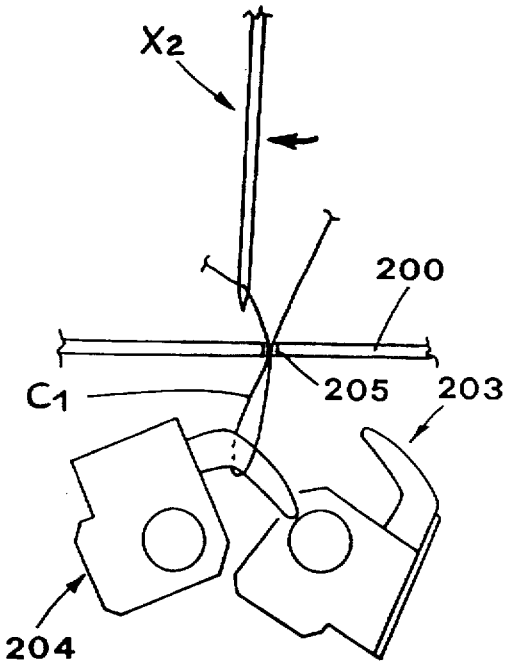
FIG.11d

METHOD FOR CLOSING A FILTER BAG FOR INFUSIBLE PRODUCTS AND FOR CONNECTING A TAGGED THREAD THERETO

TECHNICAL FIELD

The present invention relates to a filter bag for infusible products, particularly for single-dose packages of tea, extracted beverages and the like.

BACKGROUND ART

It is known that for the preparation of hot infusions, there are commonly used single-dose portions of ground product, closed in a filter bag, that is soaked at the time of consumption of the infusion in a suitable container with boiling water.

These filter bags may have different structures, according to the solutions found in order to improve the ground product expansion after it has been dipped in water, so as to allow its best dissolution.

The most common structures are obtained from a sheet of filter paper, suitably folded after the ground product has been put thereonto, and then closed so as to prevent the ground product from going out.

Most common filter bags feature one or more sections or lobes for containing the ground product, with or without the side bellow-like folds.

This filter bag is closed either by thermowelding, if it is made of thermoweldable filter paper, or by gluing different outer edges of the filter bag, or using a metallic clip blocking the said edges.

One end of a cotton thread is fixed to the filter bag, while the other end of the thread bears a tag forming the pick-up element for handling the filter bag when introduced in or withdrawn from boiling water.

The thread is usually fixed to the filter bag by gluing or using a metallic clip, or by application of a label made of thermoweldable material that connects the thread with the upper edge of the filter bag.

Also the other end of the thread can be fixed to the tag by gluing or using a metallic clip.

For filter bags produced with thermoweldable filter paper, artificially obtained or, anyway, treated materials are used. These materials, when in contact with boiling water, could release substances which can change the infusion organoleptic features.

The metallic clip is preferably used for closing filter bags (and fixing the tagged thread) made of natural fibres, that cannot be thermally welded.

Also in this embodiment, the metallic clip, when in contact with boiling water and subsequently with the extracted beverage, could contaminate the infusion.

The object of the present invention is to provide a single-dose filter bag for infusible products, and a new method for closing the same and fixing a pick-up tagged thread thereto, without using materials harmful to health.

Accordingly, elements that sometimes could appear not quite safe, like metallic clips, are not used, since they can contaminate the infusion.

DISCLOSURE OF THE INVENTION

The above mentioned object is obtained, in accordance with the contents of claims, by means of a method for closing a filter bag for infusible products, and for connecting a tagged thread to the said filter bag, the said filter bag including at least a lobe and at least a flap folded to prevent the filter bag from opening and the infusible product from going out, a pick-up tag and a connecting thread, the said method being characterised in that in that it includes fixing means for locking the said flap in a pre-determined position and simultaneously fixing a free first terminal portion of the said thread to the said filter bag, the said terminal portion being defined at an end of the said thread other than the end where a second terminal portion is defined, and destined to be fixed to the said pick-up tag.

BRIEF DESCRIPTION OF THE DRAWINGS

The characteristic features of the present invention are pointed out in the following description with reference to the enclosed drawings, in which:

FIGS. 11*a* to 11*m* show schematically working steps of the method for closing the bag, as in FIGS. 5*b*, 7, and of the method for fixing the tag to the connecting thread, as in FIG. 7.

BEST MODES OF CARRYING OUT THE INVENTION

Figure 1:
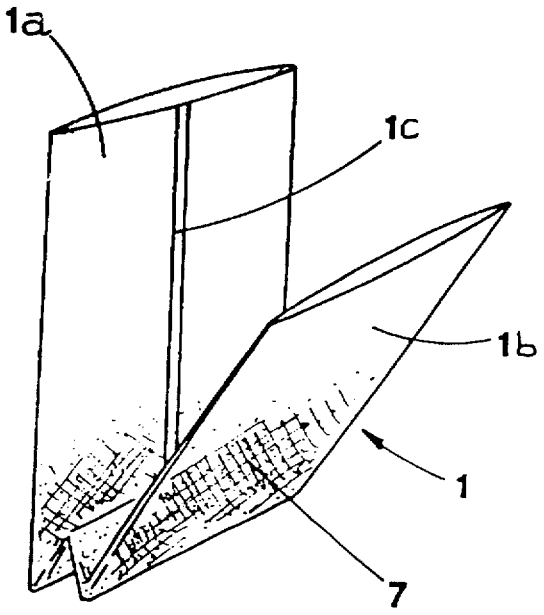
FIGS. 1 to 4 show manufacturing of a known filter bag according to conventional methods.
Figure 2:
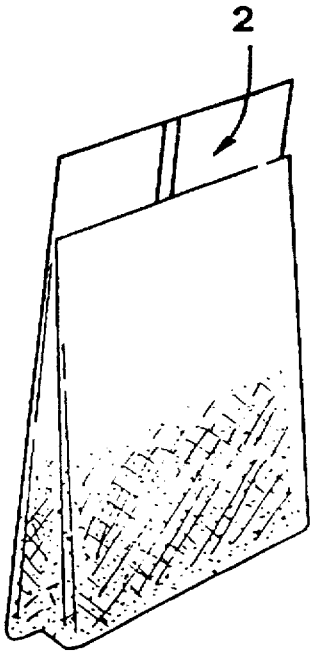
Figure 3:
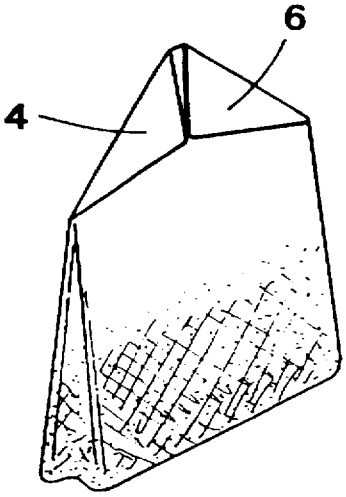
Figure 4:
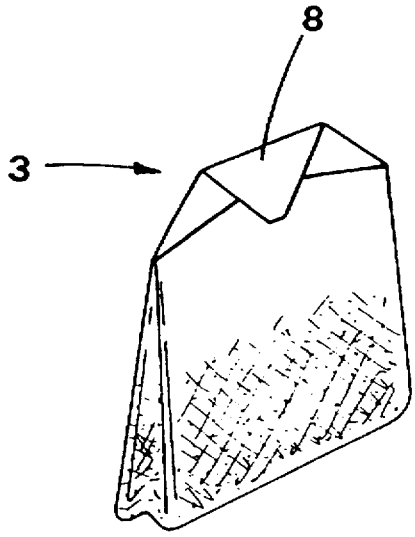

With reference to FIGS. 1 to 4, a filter bag 1 has e.g. two lobes, respectively first 1*a* and second 1*b*, suitably folded so as to face each other and form an upper edge 2 (FIG. 2).

Each lobe of the filter bag 1, that is not shown in the initial step when unfolded, is firstly filled with one dose of ground product for infusion 7, and then the filter bag is closed longitudinally by a multiple mutual folding and pressing of the outer edges 1*c*.

It will be understood that the double lobe configuration of the filter bag 1 is not limitative, but helps the description of some preferred embodiments of the present invention; therefore, it is clear that what described in the following, is applicable to different structures of the filter bag 1, e.g. the one with a single lobe.

In order to prevent the ground product 7 from going out of the filter bag 1, a flap 30 is defined by a fold 3 (FIG. 4) e.g. formed by simple foldings, respectively first 4, second 6 and third 8, made one after the other at the upper edge 2.

Fixing means 100, that carry out the proposed method, fasten the flap 30 in a predetermined position, close the filter bag, and, at the same time, fix a free first terminal portion 11 of the thread 10 thereto.

The filter bag 1 includes also a pick-up tag 13, fixed thereto by means of a thread 10, usually made of cotton.

The tag 13 facilitates insertion of the filter bag 1 into the boiling water and its subsequent withdrawal during infusion preparation.

This pick-up tag 13 is fixed to a second terminal portion 12 of the thread 10 opposite to the first terminal portion 11.

Figure 5A:
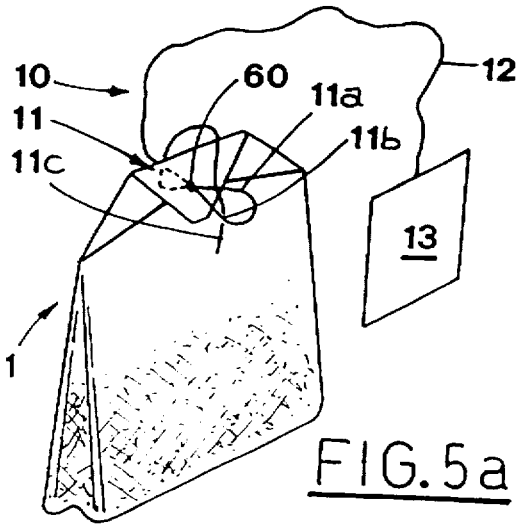
FIGS. 5*a* and 5*b* show a first embodiment of the method for closing the filter bag and simultaneously fixing a thread bearing at its other end a pick-up tag.
Figure 5B:
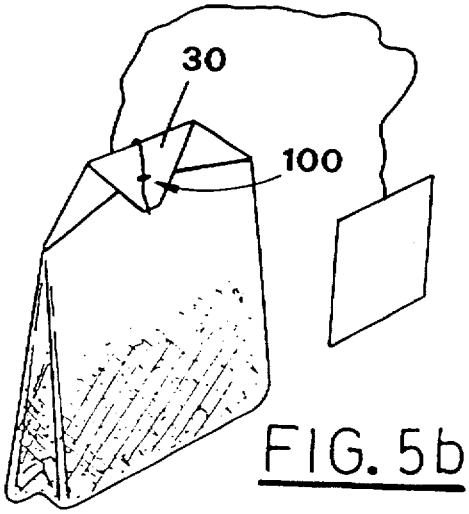

In a first embodiment of the present invention, shown in FIGS. 5*a* and 5*b*, the fixing means 100 are formed by a first auxiliary thread 31, usually made of cotton or other similar natural fibre.

The thread 31 fastens the flap 30 and, at the same time, connects the thread 10 to the filter bag 1 by a vertical stitch, e.g. chain stitch 130.

The chain stitch 130 sews also two adjacent sections 11*a*, 11*b* of the free first terminal portion 11, arranged vertically on opposite sides of the flap 30.

The two sections 11*a*, 11*b* rest on two opposite sides of the flap 30, passing over the horizontal flap line 8*b* (FIG. 5*a*), and then are sewn by the stitch 130 using the auxiliary thread 31.

Figure 6A:
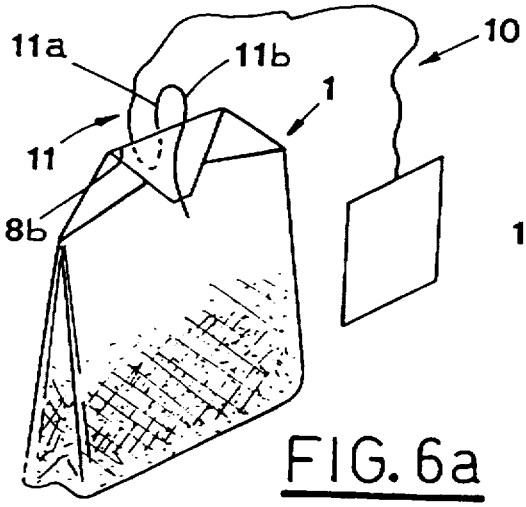
FIGS. 6*a* and 6*b* show a second embodiment of this method.
Figure 6B:
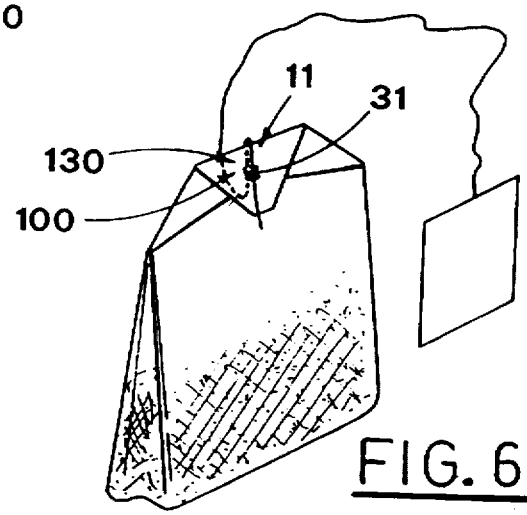

In a second embodiment, shown in FIGS. 6*a* and 6*b*, the said fixing means 100 are formed by a second auxiliary thread 41, made of cotton or another natural fibre.

In this embodiment, a straight, e.g. horizontal, short stitch 40, performed along the flap 30, closes the flap 30 and fastens the free first terminal portion 11, sewing the adjacent sections 11*a*, 11*b* thereof, arranged vertically on the opposite sides of the flap.

As in the precedent embodiment, the two adjacent sections 11*a*, 11*b* are placed on the opposite sides of the flap 30 (FIG. 6*a*), and then are sewn, by known and not illustrated sewing means, by the straight stitch 40 using the second auxiliary thread 41 (FIG. 6*b*).

In a third embodiment the fixing means 100 are constituted by the same first terminal portion 11, the terminal part 11*c* of which is used to perform, by known sewing means, like e.g. shown in FIGS. 11*a* to 11*m*, the said vertical stitch 130 along the flap 30, as described in the following.

The second terminal portion 12 of the thread 10 can be fastened to the pick-up tag 13 by sewing, preferably by a vertical stitch 70 as described in the first embodiment of the present method.

Figure 7A:
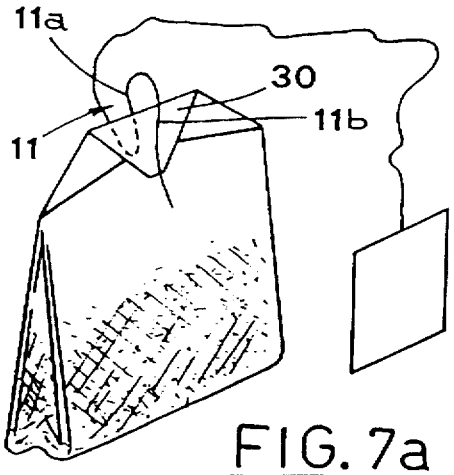
FIG. 7 shows a third embodiment of the aforementioned method.
Figure 7B:
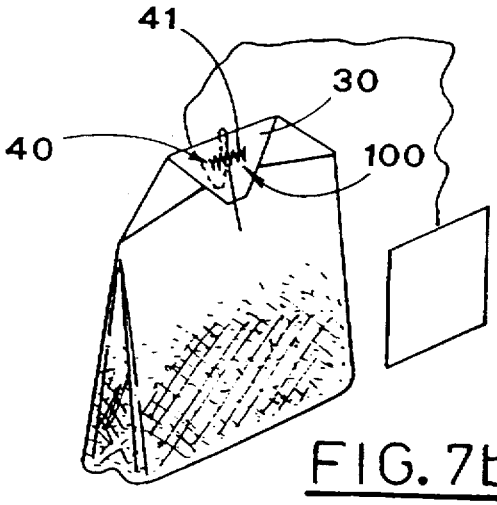
Figure 8B:
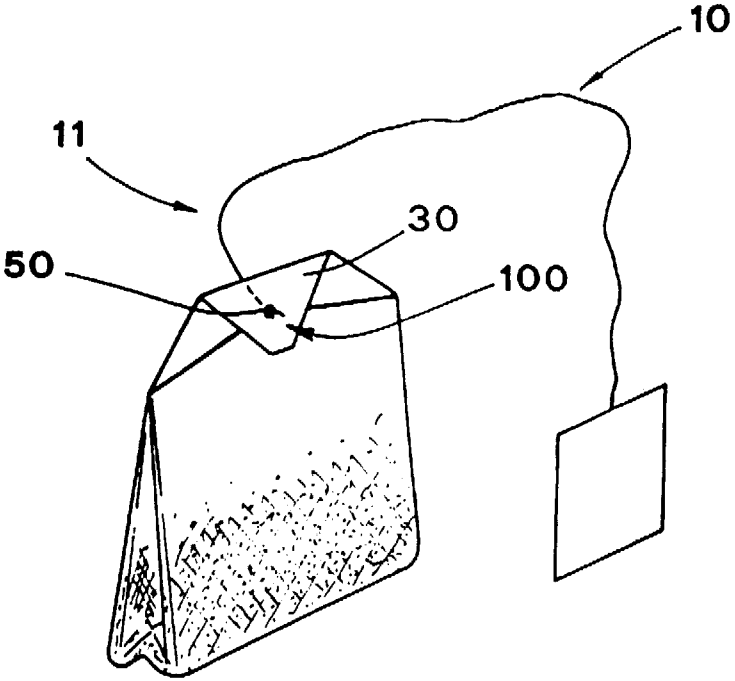
Figure 8A:
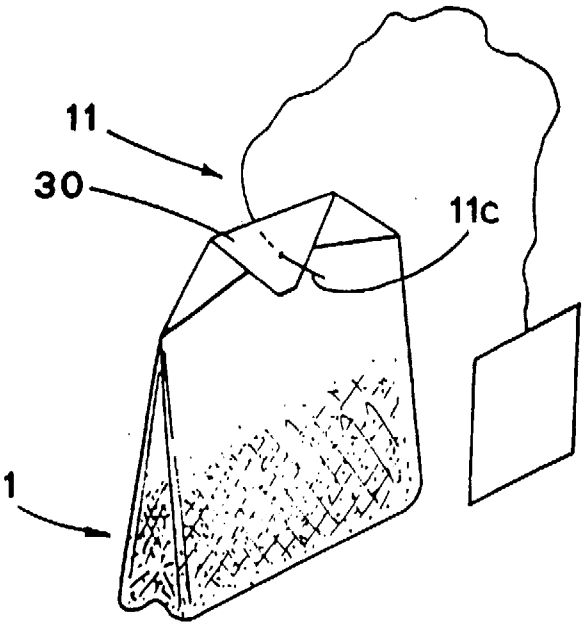
Figure 10:
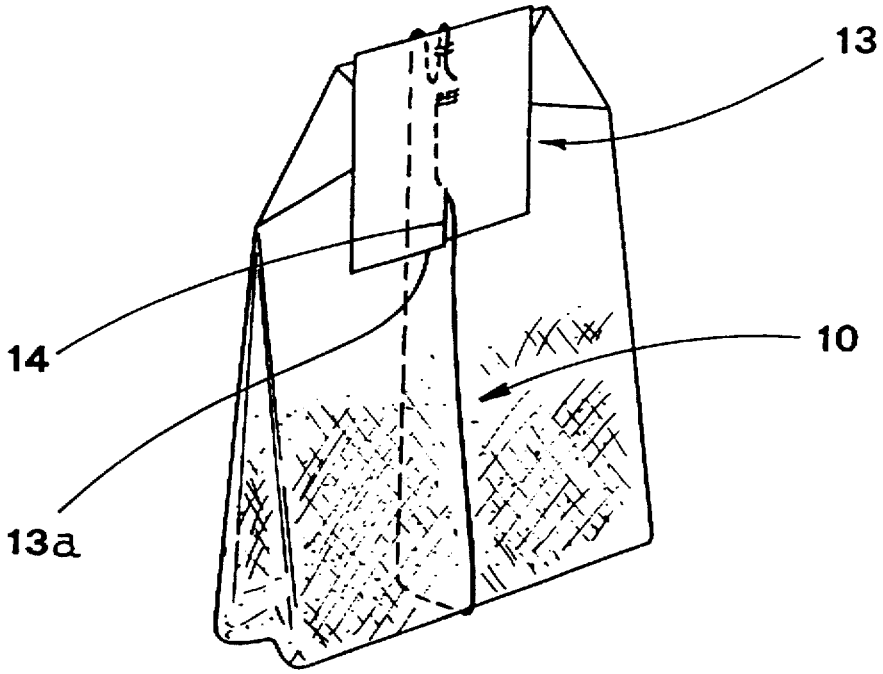

In this case, a third auxiliary thread 71 is used (FIG. 7), designed to sew, with the vertical stitch 70, two adjacent sections 12*a*, 12*b* of the second terminal portion 12 of the thread 10, arranged vertically on the opposite sides of the tag 13 and turning around the upper edge thereof.

The possible working steps to perform the vertical stitches are shown in figures from 11*a* to 11*m*.

In connection with the figures, the reference number 200 indicates the material (that is the flap 30 and the adjacent head of the filter bag 1, or tag 13), on which the stitch is made.

On one side of the material 200, there is a needle 201, provided with a thread 202, made to oscillate between two extreme working positions X1, X2, while on the other side there are positioned two rotating hooks, or looper 203, 204, that oscillate in a suitable time relation with respect to the relative axes 203*a*, 204*a* parallel one to the other.

In particular, the working positions X1, X2 are symmetrical with respect to a vertical plane, and the axes 203*a*, 204*a* are, with reference to the FIGS. 11*a* to 11*m*, respectively on the right and on the left of this plane, therefore, the respective loopers 203, 204 will be indicated respectively as right looper and left looper, and the said working positions X1, X2 are indicated, with reference to the said plane, as right and left positions.

In the FIG. 11*a*, the needle 201, in the right position X1, is outside the material. The needle 201 translates in the direction F, in synchrony with clockwise rotation K of the two loopers (with reference to the figures), passes through the material, thus making therein a hole 205 (FIG. 11*b*).

When the needle goes up, a loop C1 is formed in the part of the thread connected with the needle and it is hooked by the left looper 204 (FIG. 11*c*) rotating in the said direction K.

Figure 11E:
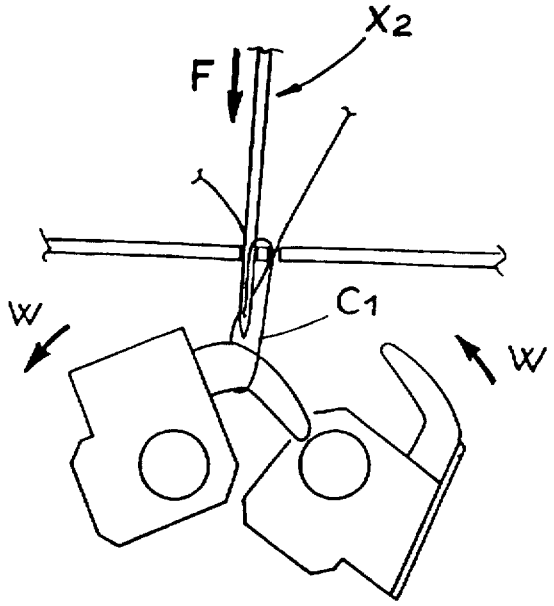

When the needle has turned up, it is brought to the left position X2 (FIG. 11*d*). The subsequent descent of the needle is in time relation with the oscillation of the two loopers in counterclockwise direction W (FIG. 11*e*).

The needle 202 is introduced in the loop C1, hooked by the left looper 204, before the latter (said looper 204) has been released from the same loop (FIG. 11*e*).

Figure 11F:
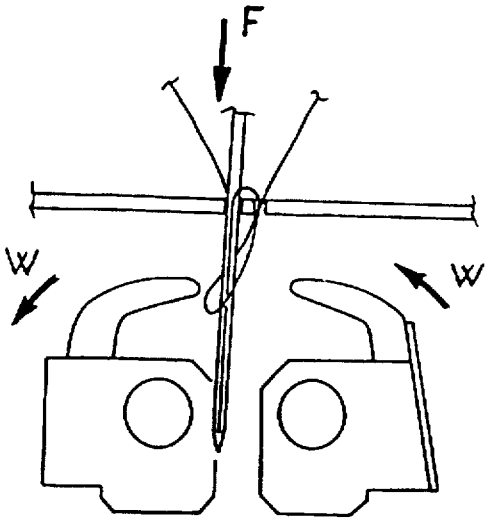
Figure 11G:
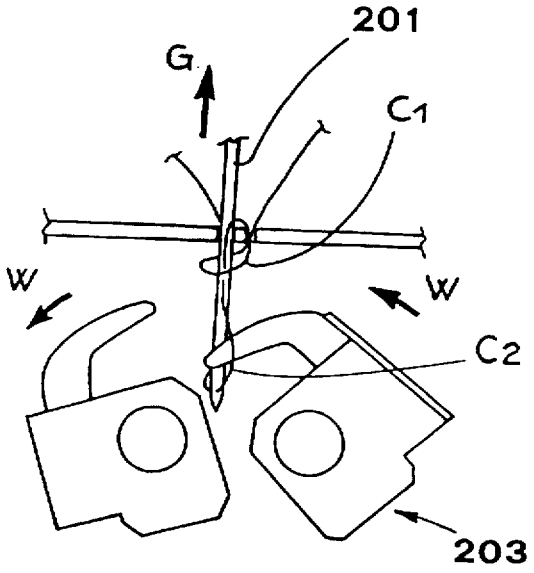
Figure 11H:
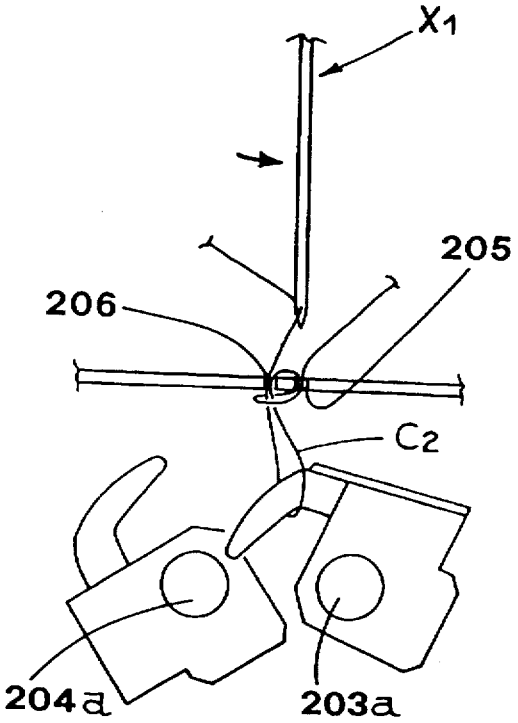
Figure 11I:
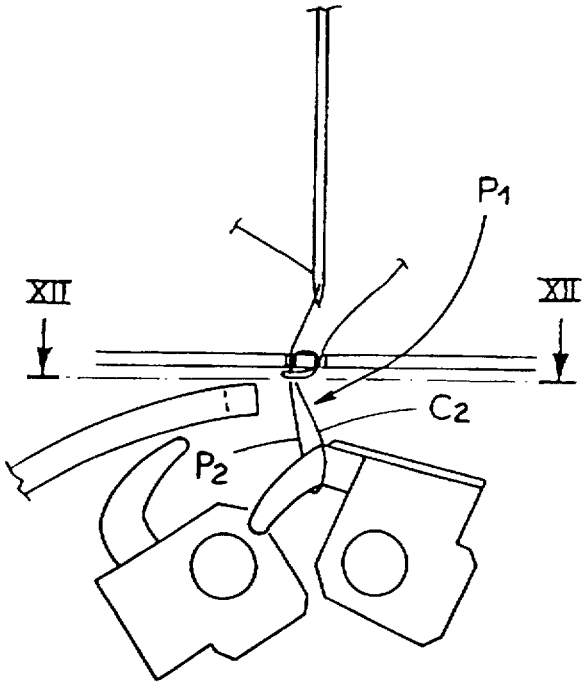
Figure 11L:
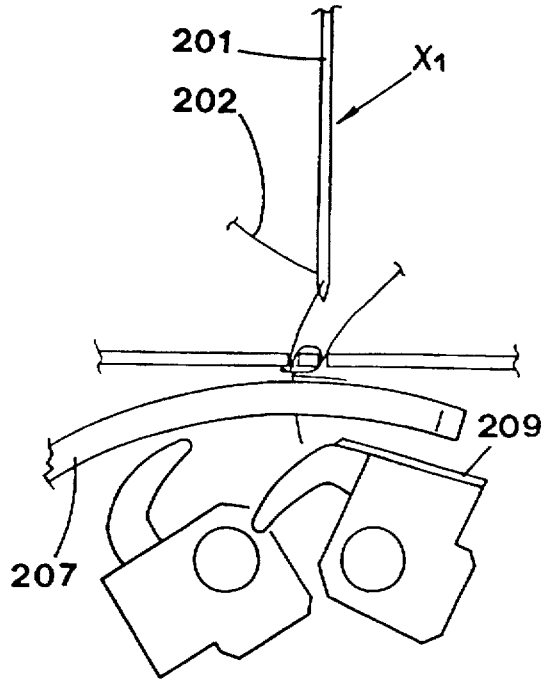
Figure 12:
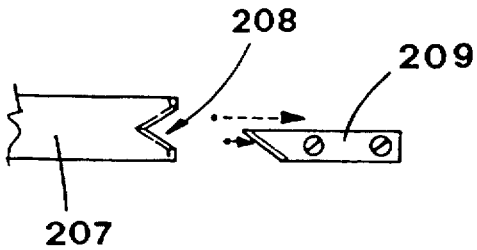

The loop C1, already released from the left looper, becomes gradually smaller, because, during the needle descent, the part of the loop, connected with the section of the thread adjacent to the needle, is pulled, thus making the same section slide from the hole 205 to the new hole 206 made in the material 200 by the needle placed in the left position X2: all this is illustrated in FIGS. 11*f*, 11*g* and 11*h*, in which the loop is deliberately loose in order to point it out.

Raising of the needle situated in the left position X2, makes a new loop (or second loop) C2 that is hooked by the right looper 203 (FIG. 11*g*), rotating in the counterclockwise direction W.

In the FIG. 11*h* the needle 201 is shown in the raised position and again in the right position X1; this figure points out that the loop C1 tightens the thread portions that go out from the hole 206 and extends so as to form the second loop C2, hooked by the right looper 203.

The working cycle described in FIGS. 11*a* to 11*h*, is usually repeated for a predetermined number of times, obviously using again the holes 205, 206. It has been found that two or three cycles are sufficient for the stitch to be made in best way.

At the end of the predetermined number of cycles, with the second loop C2 hooked by the right looper 203, a needle cutting device is activated, constituted by a circular arm, which fork-like head 208 intercepts a branch P1 of the loop C2 in order to cut it in cooperation with a cutting blade 209 situated on the back of the right looper.

Figure 11M:
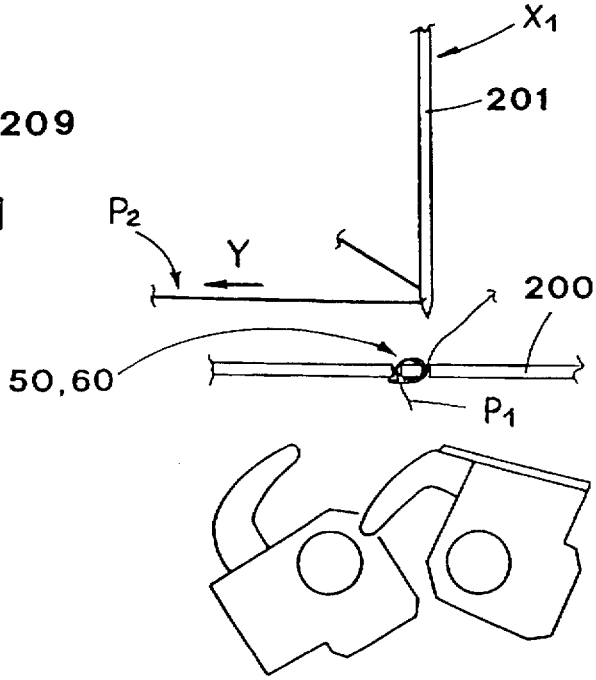

The remaining part P2 of the second loop C2 is withdrawn from the hole 206 and, subsequently, it is made translate in direction Y (FIG. 11*m*).

The so obtained stitch, has a shape that satisfies all its provided functions, in particular closes the filter bag and fixes the tag 13 to the thread 10.

The stitch is defined by a portion of thread that passes through the hole 205, beginning from a surface of the material 200, forms a loop in correspondence with the other surface, passes again through the hole 205, then crosses the adjacent surface of the material, passes through the hole 206 and the loop, the whole is tightened so as to be firmly connected with the material 200.

The conformation described above can be repeated, using the same holes, in order to improve the connection of the stitch to the material 200.

The present invention allows to obtain filter bags for infusible products exclusively of natural fibres, therefore, not harmful to health of infusion consumers.

At this point, it is particularly advantageous, to avoid filter paper made of thermoweldable materials for manufacturing filter bags.

Anyway, this possibility is not limitative, since according to the present invention, the filter bags can be made also of these thermoweldable materials or others, not described.

We claim:

1. A method for closing a filter bag for an infusible product, and for connecting a thread having a tag to said filter bag, comprising:

providing a filter bag, having at least a lobe, at least a flap folded to prevent the filter bag from opening and the infusible product from going out, providing a connecting thread, having a first terminal portion at a first end and a second terminal portion at its end opposite the first end, providing a pickup tag, placing at least two sections of the first terminal portion vertically adjacent each other on opposite sides of the flap, providing stitching means for locking said flap in a predetermined position, simultaneously fixing the first terminal portion of said connecting thread to said filter bag, by engaging an upper portion of said filter bag in the region of said flap with a portion of a first auxiliary thread made of a natural fiber, forming a short stitch, simultaneously engaging the at least two adjacent vertical sections of the first terminal portion, with the first auxiliary thread.

2. The method of claim 1 further comprising fixing the second terminal portion of the connecting thread to the pickup tag, using a second auxiliary thread forming a vertical stitch, placing at least two sections of the second terminal portion vertically adjacent each other on opposite sides of the tag near one edge thereof and engaging the vertical sections of the second terminal portion of the connecting thread with the second auxiliary thread.

3. The method of claim 1 further comprising fixing the connecting thread to both the filter bag and the pickup tag, by vertically stitching the vertically adjacent sections of the first terminal portion of the connecting thread to the bag and fixing the second terminal portion of the connecting thread to the pickup tag, using a second auxiliary thread forming a vertical stitch, placing at least two sections of the second terminal portion vertically adjacent each other on opposite sides of the tag near one edge thereof and engaging the vertical sections of the second terminal portion of the connecting thread with the second auxiliary thread.

4. The method of claim 3 further comprising passing the first and second terminal portions through first and second holes, made in the tag and the filter bag respectively, from one side to the other side, forming loops by passing again through said first and second holes, crossing the filter bag and tag respectively, passing through third and fourth holes made in said tag and in said filter bag respectively, and passing the first and second terminal portions of the threads through the loops and then tightening the threads to firmly fix the filter bag to the first terminal portion of the connecting thread and the tag to the second terminal portion of the connecting thread, respectively.

5. The method of claim 1 further comprising passing the first terminal portion through a first hole, made in an assembly formed by the flap and an upper head of the filter bag, from one side of the assembly to the other side, forming a loop by passing said first terminal portion through said first hole, crossing the surface of the assembly, passing through a second hole made in the assembly and, passing the first terminal portion through the loop, tightening the first terminal portion to firmly fix the flap to the filter bag and the assembly to said first terminal portion of the connecting thread.

6. The method of claim 1 further comprising passing the thread second terminal portion through a first hole, made in the tag, from one side of the tag to the other side, forming a loop by passing again through the first hole the thread second terminal portion, crossing the tag, passing the thread second terminal portion through a second hole made in the tag and passing the thread second terminal portion through the loop, tightening the thread second terminal portion to firmly fix the tag to the second terminal portion of the thread.

7. A method for closing a filter bag for an infusible product, and for connecting a thread having a pickup tag to said filter bag, comprising providing a filter bag, having at least a lobe, at least a flap folded to prevent the filter bag from opening and the infusible product from going out, providing a pickup tag, providing a connecting thread having a first terminal portion at a first end and a second terminal portion at its end opposite the first end, placing at least two sections of the first terminal portion vertically adjacent each other on opposite sides of the flap, providing stitch means for locking said flap in a predetermined position and simultaneously fixing the first terminal portion of said connecting thread to said filter bag, by engaging an upper portion of the filter bag in the region of the flap, with a portion of a first auxiliary thread made of a natural fiber, forming a short stitch, simultaneously engaging the at least two adjacent vertical sections of the first terminal portion, the stitch being horizontal and extending in a central part of the flap, leaving free corresponding vertical borders of the filter bag.

8. The method of claim 7, further comprising fixing the second terminal portion of the connecting thread to the pickup tag, using a second auxiliary thread forming a vertical stitch, placing at least two sections of the second terminal portion vertically adjacent each other on opposite sides of the tag near one edge thereof and engaging the vertical sections of the second terminal portion of the connecting thread with the second auxiliary thread.

9. The method of claim 7, further comprising fixing the second terminal portion of the connecting thread to the pickup tag using a second auxiliary thread, forming a horizontal stitch, placing at least two sections of the second terminal portion of the connecting thread vertically adjacent each other on opposite sides of the tag, the stitch engaging the adjacent sections of said second free terminal portion with the second auxiliary thread.

10. The method of claim 9 further comprising passing the first and second terminal portions through first and second holes, made in the tag and the filter bag respectively, from one side to the other side, forming loops by passing again through said first and second holes, crossing the filter bag and tag respectively, passing through third and fourth holes made in said tag and in said filter bag respectively, and passing the first and second terminal portions of the threads through the loops and then tightening the threads to firmly fix the filter bag to the first terminal portion of the connecting thread and the tag to the second terminal portion of the connecting thread, and the tag to the second terminal portion of the connecting thread respectively.

11. The method of claim 7 further comprising passing the first terminal portion through a first hole, made in an assembly formed by the flap and an upper head of the filter bag, from one side of the assembly to the other side, forming a loop by passing said first terminal portion through said first hole, crossing the surface of the assembly, passing through a second hole made in the assembly and, passing the first terminal portion through the loop, tightening the first terminal portion to firmly fix the flap to the filter bag and the assembly to said first terminal portion of the connecting thread.

12. The method of claim 7 further comprising passing the thread second terminal portion through a first hole, made in the tag, from one side of the tag to the other side, forming a loop by passing again through the first hole the thread second terminal portion, crossing the tag, passing the thread second terminal portion through a second hole made in the tag and passing the thread second terminal portion through the loop, tightening the thread second terminal portion to firmly fix the tag to the second terminal portion of the thread.

13. A method for closing a filter bag for an infusible product, and for connecting a thread having a pickup tag to said filter bag comprising:

providing a filter bag having at least a lobe, at least a flap folded to prevent the filter bag from opening and infusible product from going out, providing a pickup tag, providing a connecting thread, having a first terminal portion at a first end and a second terminal portion at its end opposite the first end, placing at least two sections of the first terminal portion vertically adjacent each other on opposite sides of the flap, providing stitch means for locking said flap in a predetermined position and simultaneously fixing the first terminal portion of said connecting thread to said filter bag, by engaging an upper portion of said filter bag in the region of said flap with a first auxiliary thread made of a natural fiber, forming a short vertical stitch simultaneously engaging the at least two adjacent vertical sections of said free first terminal portion located on opposite sides of said flap with the first auxiliary thread, placing at least two sections of the second terminal portion vertically adjacent each other on opposite sides of the tag near one edge thereof fixing the second terminal portion of the thread to said pickup tag using a second auxiliary thread forming a vertical stitch, engaging the vertical sections of the second terminal portion with the second auxiliary thread.

14. The method of claim 13 further comprising passing the first terminal portion through a first hole, made in an assembly formed by the flap and an upper head of the filter bag, from one side of the assembly to the other side, forming a loop by passing said first terminal portion through said first hole, crossing the surface of the assembly, passing through a second hole made in the assembly and, passing the first terminal portion through the loop, tightening the first terminal portion to firmly fix the flap to the filter bag and the assembly to said first terminal portion of the connecting thread.

15. The method of claim 13 further comprising passing the thread second terminal portion through a first hole, made in the tag, from one side of the tag to the other side, forming a loop by passing again through the first hole the thread second terminal portion, crossing the tag, passing the thread second terminal portion through a second hole made in the tag and passing the thread second terminal portion through the loop, tightening the thread second terminal portion to firmly fix the tag to the second terminal portion of the thread.

16. The method of claim 13 further comprising passing the first and second terminal portions through first and second holes, made in the tag and the filter bag respectively, from one side to the other side, forming loops by passing again through said first and second holes, crossing the filter bag and the tag respectively, passing through third and fourth holes made in said tag and in said filter bag respectively, and passing the first and second terminal portions of the threads through the loops and then tightening the threads to firmly fix the filter bag to the first terminal portion of the connecting thread, and the tag to the second terminal portion of the connecting thread respectively.

* * * * *